US006161603A

United States Patent [19]

Rautio

[11] Patent Number: 6,161,603

[45] Date of Patent: Dec. 19, 2000

[54] PROCEDURE AND APPARATUS FOR WORKING A TREE TRUNK BY CHIPPING

[76] Inventor: Kauko Rautio, Kolmihaarantie 1, Mäntyharju, Finland, 52700

[21] Appl. No.: 08/786,707

[22] Filed: Jan. 21, 1997

[30] Foreign Application Priority Data

Jan. 19, 1996 [FI] Finland ..... 960291

[51] Int. Cl.[7] ..... B27B 1/00; B27L 7/00; B27C 9/00

[52] U.S. Cl. ..... 144/357; 144/3.1; 144/39; 144/369; 144/377; 144/378

[58] Field of Search ..... 144/3.1, 39, 41, 144/356, 357, 367, 369, 370, 373, 377, 378

[56] References Cited

U.S. PATENT DOCUMENTS

| | | | |
|---|---|---|---|
| 4,327,789 | 5/1982 | Reuter . | |
| 4,440,203 | 4/1984 | Östberg | 144/39 |
| 4,485,861 | 12/1984 | Nilsson et al. | 144/39 |
| 4,572,256 | 2/1986 | Rautio | 144/39 |
| 4,879,659 | 11/1989 | Bowlin et al. . | |
| 4,881,584 | 11/1989 | Wislocker et al. | 144/39 |
| 5,143,127 | 9/1992 | Rautio | 144/39 |
| 5,257,101 | 10/1993 | Lee . | |
| 5,320,153 | 6/1994 | Knerr | 144/3.1 |
| 5,396,938 | 3/1995 | Cannaday | 144/357 |
| 5,447,186 | 9/1995 | Achard et al. . | |
| 5,884,682 | 3/1999 | Kennedy et al. | 144/357 |

FOREIGN PATENT DOCUMENTS

| | | |
|---|---|---|
| 663272 | 7/1995 | European Pat. Off. . |
| 2503613 | 10/1982 | France . |

*Primary Examiner*—W. Donald Bray
*Attorney, Agent, or Firm*—Baker Botts L.L.P.

[57] ABSTRACT

Procedure for working curved tree trunks by chipping into timber products, such as boards and cants, in which procedure the trunk (T) is crook-chipped and a straight side board (S1) is edged at the same time. The invention also relates to an apparatus for implementing the procedure.

11 Claims, 2 Drawing Sheets

PROCEDURE AND APPARATUS FOR WORKING A TREE TRUNK BY CHIPPING

The present invention relates to a procedure as defined in the preamble of claim 1 for working tree trunks by chipping. The invention also relates to an apparatus as defined in claim 5.

In prior art, solutions are known in which a tree trunk is first crook-chipped, whereupon the side boards are sawed off the log. The side boards are then edged by means of a separate edging device. Transporting the side boards to a separate edging device requires specific conveyor and other equipment, involving additional expenses both for the equipment and the space needed.

The object of the present invention is to achieve a completely new type of procedure and a new apparatus for the sawing of boards or equivalent from logs. The procedure and apparatus of the invention are characterized by what is presented in the claims.

The procedure of the invention has numerous significant advantages. By applying the procedure of the invention, it is possible to combine simultaneous curvilinear chipping and edging of side boards so that a crook-sawn balk and a straight board are produced simultaneously in a controlled manner. By tilting the axle of the edging unit, a smooth and clean edge surface of the side board is achieved. The procedure can be applied regardless of whether the edging is performed before or after the sawing of the side board. The apparatus of the invention takes up less space than conventional apparatus. Moreover, only one profile measurement is needed to obtain blade settings for side boards as well, because the side boards remain in the same position relative to the balk. This also enables the board width to be quickly adjusted for each trunk. Side boards sawn from the same trunk can be different widths.

Figure 1:
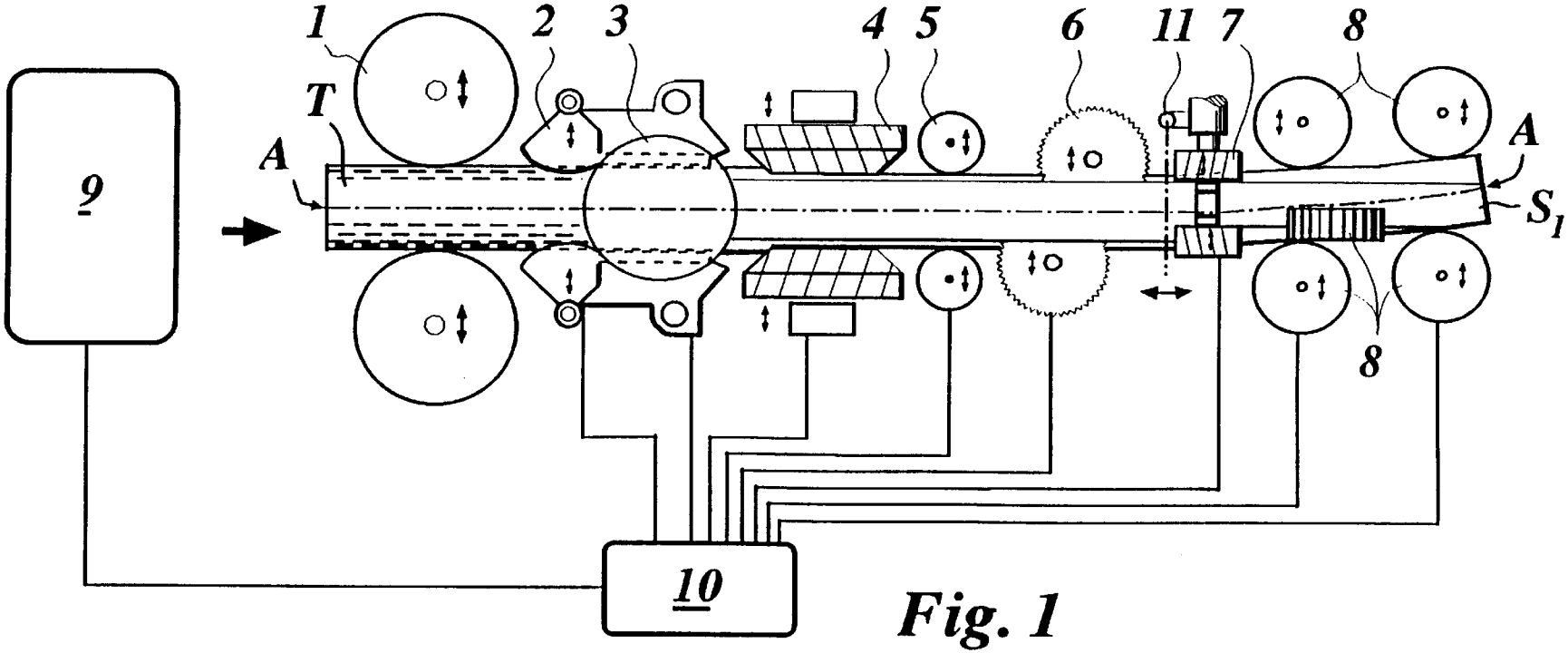
Figure 2:
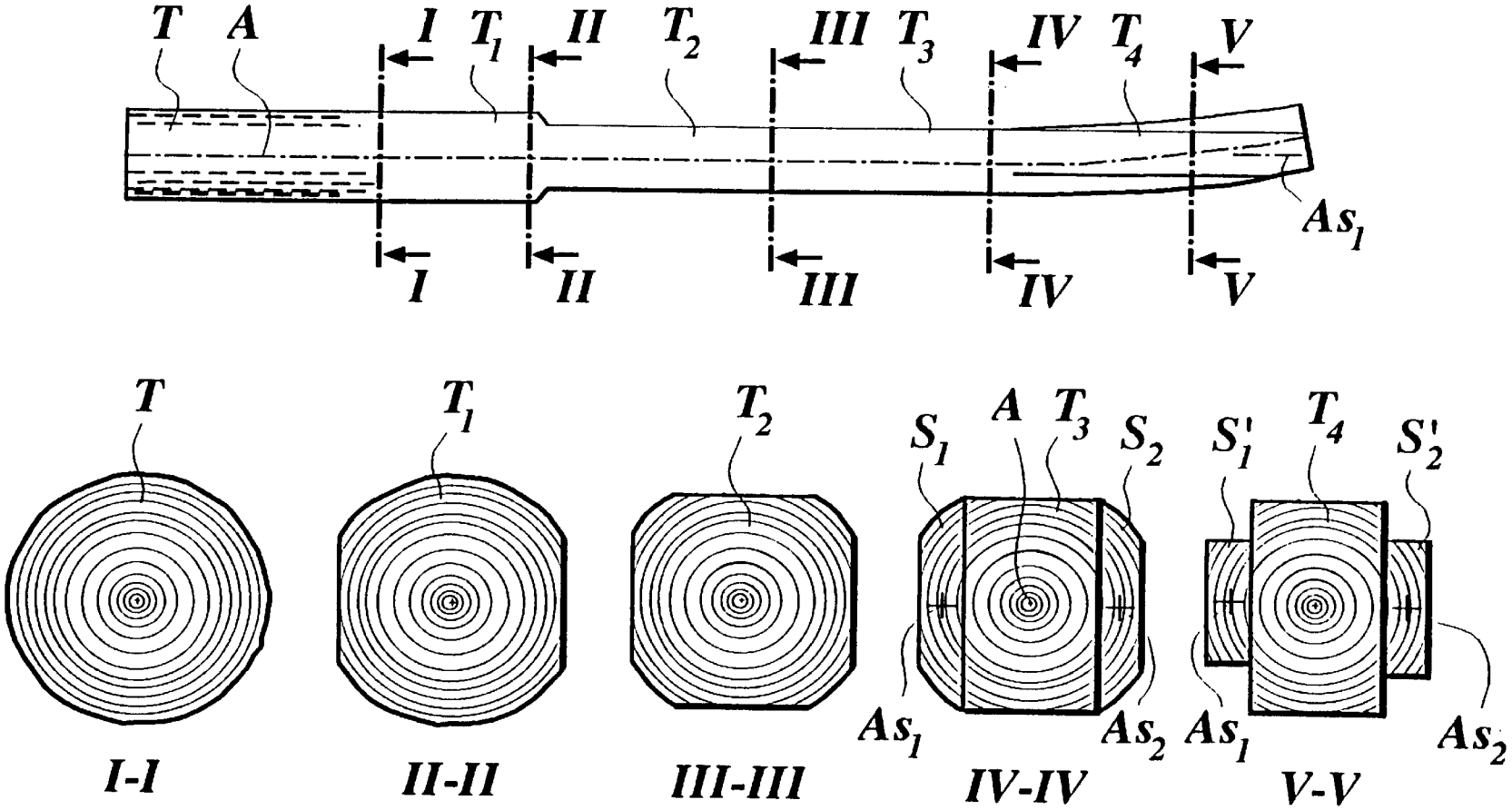

In the following, the invention is described by referring to the attached drawings, in which FIG. 1 presents the apparatus of the invention in a simplified side view, and FIG. 2 presents as an auxiliary illustration of a tree trunk being worked by the apparatus and cross-sections taken through it at different working stages.

FIG. 1 presents a diagram representing an apparatus according to the invention. The apparatus is preceded in the feed direction by a measuring device 9, which measures the geometric data relating to the trunk and transfers the information to a control unit 10. Based on the measurement data and other data fed into the control unit 10, the system determines an optimal working axis A and optimal side board widths for each log as well as the centre lines As1 and As2 of each side board.

The apparatus preferably comprises feed wheels 1 placed on opposite sides of the trunk T, the trunk being fed in between the wheels. After the wheels there are log guides 2 and after these a first set of chipping cutter heads 3, between which the trunk is fed in by means of the feed wheels 1 and the log guides 2. After the first pair of chipping cutter heads 3 there is a second pair of chipping cutter heads 4, so when the log has passed through between the latter chipping cutter heads, it has four trimmed surfaces. However, the corners of the piece of timber thus produced still have unmachined dull edges.

After the second set of chipping cutter heads 4 in the feed direction in the apparatus there are driving rollers 5 and after these there are sawing elements 6, such as circular saw blades, by means of which the side board is sawed in such a way that at least part of the dull edge remains on the side board S1, S2.

The dull edge remaining on the side board is machined by means of the chipping head 7 of an edging unit. The side board S1, S2 is moved together with the balk T3, T4 so that the side board S1, S2 remains during the edging operation in the same position as before the sawing.

Alternatively, the sawing elements 6 of the apparatus may be placed after the edging units 7.

The edging unit has preferably two chipping heads 7 on opposite sides of the trunk T, in which case the side boards S1, S2 on both sides of the trunk can be edged at the same time. The chipping heads 7 are arranged to be movable in the direction of their axis of rotation. The chipping heads 7 can be turned about an axis 11 transverse to the centre line of the working apparatus. The chipping heads are turned by means of a regulating unit (not shown) controlled by the control unit 10.

In the figure, the directions of motion of the feeding, handling and regulating elements are indicated with arrows.

In the apparatus, driving rollers 8 draw the sawn central section T4 together with the side boards S1, S2 away from the working apparatus.

Applying the procedure of the invention, the tree trunk is treated as follows:

First, the geometry of the trunk T is measured. Based on the measurement, a three-dimensional model of the trunk is created, showing the diameter, curvature and conicity of the trunk. The measurement can be performed e.g. by directing a laser line at the trunk at an oblique angle and using a camera perpendicular to the trunk to measure the form of the laser line projected onto the trunk. The trunk is moved forward and measurements are performed at certain intervals, thus obtaining measurement data for the whole trunk. When corresponding equipment is provided on both sides of the trunk, a three-dimensional model based on the measurement data is obtained for each trunk. The measurement is known in itself and it may be performed by any method that enables the geometry of the trunk to be determined. The measuring device 9 is connected to the control unit 10, which is used to control the working apparatus and the associated feeding, working and guiding elements 1–8. Based on the measurement, values describing the path of each device supporting the trunk are preferably calculated in advance, and these values are used to control the device with respect to the movement of the trunk.

The curvature of the log T is turned to a desired direction using e.g. a mechanical turning device (not shown). In the case illustrated by the figures, the curvature has been turned downward.

Based on the geometry measurement, the chipping axis A is determined in terms of a distance from a known surface, e.g. the lower surface of the trunk.

An optimal position for the centre axis As1, As2 of the side board S1, S2 relative to the chipping axis A as well as an optimal width of the side board S1, S2 are determined. Thus, for each trunk, an optimal handling scheme and direction are defined. The optimization can also be based e.g. on value yield and not merely on optimizing the volume.

The trunk is guided by holding it by a known surface, e.g. the lower surface, between working devices such as the chipping cutter heads 3, 4 so that the chipping axis A passes between the chipping cutter heads 3, 4, and so that the tangent to the chipping axis is parallel to the centre line of the working apparatus at a given point on the machine. The trunk is supported by the feeding and guiding elements 1, 2, 5, which are controlled by the control unit 10 on the basis of the geometry data for each trunk.

The chipping heads 7 are adjusted to the optimized width of the side board S1, S2 and preferably so controlled that they will move symmetrically relative to the defined centre axis As1, As2 of the side board. In the case illustrated by the figures, the centre axis of side board S1 is straight, whereas the working axis, especially the chipping axis A is curved. The centre axis of the side board S1 may differ from a straight line e.g. in cases where there is a need to anticipate the deformation resulting from tensions.

The axle of each chipping head 7 is turned e.g. about a transverse axis 11 so that it is substantially perpendicular to the centre axis As1, As2 of the side board S1, S2 regardless of the position of the trunk. The angle through which the chipping head 7 is to be turned is obtained e.g. by calculating the angle of the tangent to the chipping axis relative to the centre axis of the side board and tilting the axle of the chipping head to the same angle relative to the centre axis of the sawing machine. In this way, simultaneous curvilinear chipping of the lateral surfaces of the trunk and edging of the sideboard are achieved, producing a crook-sawn balk and a straight side board in a controlled manner. Tilting the chipping head 7 allows a smooth side board edge surface of good quality to be achieved. The procedure can be applied regardless of whether the edging is performed before or after the sawing of the side board. Where a lower quality or the side board surface is sufficient, the chipping head can be set to a fixed angle such that the clearing angle is preserved in all circumstances.

FIG. 2 presents a trunk T and its cross-sections at different working stages in FIG. 1. In the figure, the working axis A is depicted with a broken line. The centre axis As1 of the side board is shown with a dotted broken line at the right-hand end of the trunk in FIG. 2. Section I—I shows the trunk before the machining. Section II—II shows the trunk after it has been worked by the first set of chipping cutters 3. Section III—III shows the trunk after it has been worked by the second set of chipping cutters 4. Section IV—IV shows the trunk after the sawing of the side boards, and section V—V after the edging of the side boards. From FIG. V—V it can be seen that the sideboards S'1 and S'2 may differ from each other in width and that their centre axes As1 and As2 may lie at different levels in the vertical direction.

It is obvious to a person skilled in the art that the invention is not limited to the embodiment described above, but that it can be varied within the scope of the following claims.

What is claimed is:

1. A method for working a curved tree trunk into timber products, comprising the following steps performed in the following order:

measuring the geometry of the trunk;

based on the geometry establishing a working axis of the trunk as a function of distances from a selected surface of the trunk, an optimal position of a center axis of at least one side board relative to the working axis, and an optimal width of the at least one side board;

feeding the trunk along a working machine while supporting the trunk on the selected surface such that the working axis passes between a first pair of working cutting heads and a second pair of working cutting heads and such that a tangent to the working axis is parallel to a center line of the working machine at a given point on the machine;

trimming the trunk with the first pair of working cutting heads and the second pair of working cutting heads so as to form opposite side surfaces and top and bottom surfaces; and sawing the trunk with at least one sawing element and chipping the trunk with a pair of chipping heads of an edging unit so as to sever the at least one side board from a balk of the trunk and edge the at least one side board, the chipping heads being adjusted to a selected width of the at least one side board and the edging unit being moved according to the optimal center axis of the at least one side board.

2. The method according to claim 1 and further comprising the step of turning the edging unit about an axis perpendicular to the optimal center axis of the at least one side board regardless of the position of the trunk.

3. The method according to claim 1, wherein the step of sawing the trunk precedes the step of edging the at least one side board.

4. The method according to claim 1, wherein the step of edging the at least one side board precedes the step of sawing the trunk.

5. The method according to claim 3, wherein the at least one side board and the balk are moved together and kept at a distance from each other by a dividing element proximate to the chipping heads of the edging unit.

6. A machine for working a tree trunk into timber products, comprising:

feeding and guiding elements for moving the trunk in a predetermined path;

two pairs of chipping cutter heads for trimming at least parts of the sides, top and bottom of the trunk while leaving dull edges at corners of the trunk;

a sawing element for severing a side board from the trunk and leaving a balk; and an edging unit having a pair of chipping heads for chipping dull edges on one side of the trunk to form the edges of the side board, the edging unit being mounted for pivotal movement about an axis transverse to a center line of the machine.

7. The machine according to claim 6, wherein the sawing element is disposed before the edging unit relative the direction of movement of the trunk.

8. The machine according to claim 6, wherein the edging unit is disposed before the sawing element relative the direction of movement of the trunk.

9. The machine according to claim 6, and further comprising:

a control unit for controlling the feeding and guiding elements, the pairs of chipper cutter heads, the sawing element, and the edging unit; and a measuring device for determining the geometry of the trunk and providing measurement values to the control unit.

10. The machine according to claim 6, wherein the control unit controls the pivotal movement of the edging unit about the axis transverse to the center line of the machine so that the axle of the edging unit is substantially perpendicular to a defined center axis of the side board.

11. The machine according to claim 6, and further comprising a second sawing element and a second edging unit for forming a second side board on a side of the trunk opposite from said side board.

* * * * *